US006347512B1

(12) United States Patent
Kolmanovsky et al.

(10) Patent No.: US 6,347,512 B1
(45) Date of Patent: Feb. 19, 2002

(54) METHOD AND SYSTEM FOR CONTROLLING A LEAN $NO_X$ TRAP PURGE CYCLE

(75) Inventors: Ilya Vladimir Kolmanovsky, Ypsilanti; Jing Sun, Bloomfield, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/560,866

(22) Filed: Apr. 28, 2000

(51) Int. Cl.[7] ..... F01N 3/00
(52) U.S. Cl. ..... 60/274; 60/285; 60/301
(58) Field of Search ..... 60/274, 285, 286, 60/295, 301

(56) References Cited

U.S. PATENT DOCUMENTS 6,012,282 A * 1/2000 Kato et al. ..... 60/285
6,119,449 A * 9/2000 Köhler ..... 60/274
6,161,378 A * 12/2000 Hanaoka et al. ..... 60/285
6,167,695 B1 * 1/2001 Itou et al. ..... 60/301

* cited by examiner

*Primary Examiner*—Thomas Denion
*Assistant Examiner*—Tu M. Nguyen
(74) *Attorney, Agent, or Firm*—Jerome R. Drouillard

(57) ABSTRACT

An adaptive control method for managing a LNT purge cycle includes a model for predicting the feedgas $NO_x$ and CO emissions for both stratified and homogeneous engine operating conditions where the parameters of the model are updated based on real-time HEGO sensor measurements in order to adjust the model to ensure robustness of performance in determining the entry and exit condition for purge operation to thereby reduces HC/CO breakthrough, and to improve purge efficiency and fuel economy.

15 Claims, 2 Drawing Sheets

METHOD AND SYSTEM FOR CONTROLLING A LEAN $NO_X$ TRAP PURGE CYCLE

TECHNICAL FIELD

This invention relates to after-treatment control schemes and, more particularly, to adapting parameters of a predictive model for estimating the feedgas $NO_x$ and CO emissions, and the amount of $NO_x$ stored in a Lean $NO_x$ Trap (LNT) of a Direct-Injection, Stratified-Charge (DISC) engine system based on real-time HEGO sensor measurements.

BACKGROUND ART

DISC engines equipped with a lean $NO_x$ trap (LNT) require a sophisticated after-treatment control scheme to manage the LNT purge cycle while responding to driver's torque demands. In order to effectively manage the activation and deactivation of the LNT purge cycle and optimize fuel economy, a predictive model for feedgas emissions of $NO_x$ and CO is used. This emissions model, in combination with a Three-Way Catalyst (TWC) conversion efficiency model and LNT $NO_x$ storage/release model, provides a real-time estimate of the $NO_x$ stored in the LNT and, therefore, provides a critical input for the engine management system to decide when to start or stop the LNT $NO_x$ purge operation. However, because of the complicated nature of the DISC engine operation, the conventional feedgas $NO_x$ predictive model cannot be applied.

For a Port Fuel Injection (PFI) or DISC engine with LNT and a HEGO sensor downstream of the LNT, the decision to terminate the purge is made when a HEGO switch is detected. This strategy relies on the detection of HC/CO breakthrough to determine the status of the LNT. The time delay in the system, however, may lead to excess HC and CO in the tailpipe and cause other emission concerns.

Unlike a PFI engine which operates most of the time at stoichiometric air/fuel ratio and whose after-treatment control is achieved primarily by controlling the air/fuel ratio around the stoichiometric value, a DISC engine operates over a wide rage of air/fuel ratios and involves multiple modes of operation. The tailpipe $NO_x$ is a function of many engine variables, as well as the present LNT state (the mass of $NO_x$ stored in the trap). The performance of a $NO_x$ predictive model, which is calibrated off-line to give the best estimation of feedgas $NO_x$, may be susceptible to changes that are due, for example, to engine aging, component-to-component variation, temperature and humidity variation, etc. These changes are relatively slow as compared to engine operating variable changes, and the effects of these changes are usually not incorporated in the model.

DISCLOSURE OF INVENTION

In accordance with the present invention, an after-treatment control scheme for managing a LNT purge cycle is disclosed. The control scheme includes a new model structure as well as new algorithms that predict the feedgas $NO_x$ emissions for both stratified and homogeneous operating condition. In addition, an adaptive scheme for updating the predictive $NO_x$ model based on real-time HEGO sensor measurements is provided to adjust the $NO_x$ model to ensure robustness of performance and simplify the model structure. Using a combination of HEGO measurement and $NO_x$ model prediction to determine the entry and exit condition for purge operation reduces HC/CO breakthrough, thus improving purge efficiency, emission performance and fuel economy.

BRIEF DESCRIPTION OF DRAWINGS

A more complete understanding of the present invention may be had from the following detailed description which should be read in conjunction with the drawings in which.

BEST MODE FOR CARRYING OUT THE INVENTION

Figure 1:
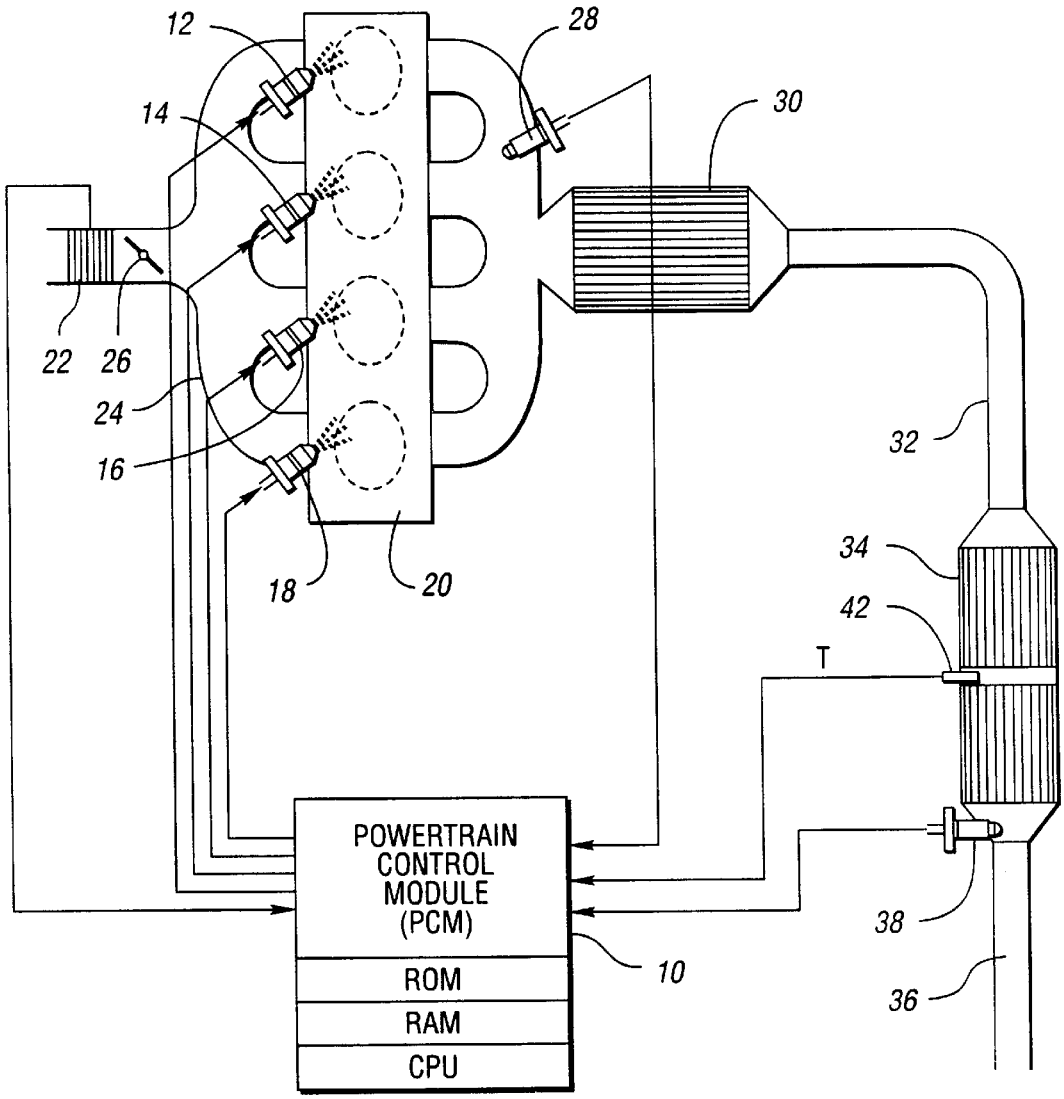
FIG. 1 is a block diagram representation of the system of the present invention.

Referring now to the drawing and initially to FIG. 1, a block diagram of the control system of the present invention is shown. The system comprises an electronic engine controller generally designated that includes ROM, RAM and CPU as indicated. The controller 10 controls a set of injectors 12, 14, 16 and 18 which inject fuel into an 4 cylinder internal combustion engine 20. The fuel is supplied by a high pressure fuel system (not shown) and is injected directly into the combustion chambers in precise quantities and timing as determined by the controller 10. The controller 10 transmits a fuel injector signal to the injectors to produce engine torque and maintain an air/fuel ratio determined by the controller 10. An air meter or air mass flow sensor 22 is positioned at the air intake of the manifold 24 of the engine and provides a signal regarding air mass flow resulting from positioning of the throttle 26. The air flow signal is utilized by controller 10 to calculate an air mass (AM) value which is indicative of a mass of air flowing into the induction system. A heated exhaust gas oxygen (HEGO) sensor 28 detects the oxygen content of the exhaust gas generated by the engine, and transmits a signal to the controller 10. Sensor 28 is used for control of the engine A/F, especially during any stoichiometric operation.

An exhaust system, comprising one or more exhaust pipes, transports exhaust gas produced from combustion of an air/fuel mixture in the engine to a conventional close-coupled, three-way catalytic converter (TWC) 30. The converter 30 contains a catalyst material that chemically alters exhaust gas that is produced by the engine to generate a catalyzed exhaust gas. The catalyzed exhaust gas is fed through an exhaust pipe 32 to a downstream $NO_x$ trap 34 and thence to the atmosphere through a tailpipe 36.

A HEGO sensor 38 is located downstream of the trap 34, and provides a signal to the controller 10 for diagnosis and control according to the present invention. The trap 34 contains a temperature sensor 42 for measuring the midbed temperature T which is provided to the controller 10. Alternatively, the midbed temperature may be estimated using a computer model. Still other sensors, not shown, provide additional information about engine performance to the controller 10, such as crankshaft position, angular velocity, throttle position, air temperature, other oxygen sensors in the exhaust system, etc. The information from these sensors is used by the controller to control engine operation.

The amount of $NO_x$ stored in the LNT depends on the feedgas $NO_x$ emission as well as the TWC conversion and LNT trapping efficiencies. The predictive feedgas $NO_x$ /LNT model is described by the following equations:

$$W_{nox}=(a(N,P,r_c,F_c)+b(N,P,r_c,F_c)(\delta-\delta_{MBT}))W_f \quad (1)$$

$$\dot{m}_{nox} = f_c W_{nox}\left(1 - \frac{m_{nox}}{c_{lnt}}\right) \text{ in normal operation} \quad (2)$$

$$\dot{m}_{nox} = -W_{co}(N, P) \text{ in purge operation} \quad (3)$$

where $W_f$ fueling rate $W_{nox}$ estimate of feedgas $NO_x$ flow rate $W_{co}$ estimate of feedgas CO flow rate $m_{nox}$ total $NO_x$ stored in LNT N engine speed P intake manifold pressure $r_c$ in-cylinder air/fuel ratio $F_c$ in-cylinder burned gas fraction $\delta$ spark timing $\delta_{MBT}$ spark timing corresponds to maximum brake torque $c_{lnt}$ the LNT storage capacity, dependent on trap temperature $f_c$ a compounded factor of TWC conversion and LNT absorbing efficiencies The regression a and b in (1) and $W_{co}$ in (3) are determined from engine mapping data. While N and P are measured, $r_c$ and $F_c$ are estimated. For DISC engines, two different algebraic functions are needed to represent the $NO_x$ emission performance in stratified and homogeneous operations. $W_{co}$, like $W_{nox}$, in general is a function of many variables, including engine speed, load, air/fuel ratio, EGR rate, etc. Assuming the LNT is purged at a fixed air/fuel ratio (say 14:1) with no EGR, $W_{co}$ is taken as a function of engine speed and load. Depending on the trap formulation, HC can also affect the LNT purge operation. The involvement of HC in the purge is similar to that of CO. During normal lean operation, $f_c$ can be set to, for example, 0.8, to reflect the fact that only 80% of the feedgas $NO_x$ will affect the LNT trapping process. The rest is either converted by the TWC, or escapes to the tailpipe. This number $f_c$ can be affected by sulphur poisoning, temperature, or other factors.

Let $W_{nox}^0, W_{co}^0, f_c^0, c_{lnt}^0$ be the nominal models for the feedgas $NO_x$, CO, a compounded factor of TWC conversion and LNT absorbing efficiencies, and LNT storage capacity, respectively, which are determined from the engine and after-treatment mapping data or optimized during calibration. Consider different uncertainties (such as aging, poisoning, component variability, etc.) which may affect the performance of feedgas emissions and LNT storage models. The correct model is then represented by:

$$W_{nox} f_c = g_1 W_{nox}^0 f_c^0$$

$$W_{co} = g_2 W_{co}^0$$

$$c_{lnt} = g_3 c_{lnt}^0$$

where $g_1, g_2, g_3$ are variables to capture the other effects that are not accounted for in the original nominal model $g_i$, are parameters that are set to be equal to 1 in off-line calibration, and adjusted on-line based on real-time measurement to improve robustness and performance.

Consider one normal-purge cycle, let $\Delta_n$ be the time interval spent in the normal mode and $\Delta_p$ be the total time spent in the purge mode. Assuming the LNT starts with zero initial condition, then by the end of the purge cycle, the amount of $NO_x$ stored in the LNT is given by:

$$m_{nox}^e = \left(1 - e^{-\frac{g_1 f_c^0 W_{nox}^0 \Delta_n}{g_3 c_{lnt}^0}}\right) g_3 c_{lnt}^0 - g_2 W_{co} \Delta_p.$$

Redefining the parameters: $\theta_1 = g_1/g_3$, $\theta_2 = g_3$, $\theta_3 = g_2$, we have the following parametric model:

$$m_{nox}^e = \theta_2\left(1 - e^{-\frac{\theta_1 f_c^0 W_{nox}^0 \Delta_n}{c_{lnt}^0}}\right) c_{lnt}^0 - \theta_3 W_{co}^0 \Delta_p. \quad (4)$$

For any $\theta_1$, $\theta_2$, $\theta_3$, we can define the estimation error as:

$$e = m_{nox}^e - m_{nox}^d = \theta_2\left(1 - e^{-\frac{\theta_1 f_c^0 W_{nox}^0 \Delta_n}{c_{lnt}^0}}\right) c_{lnt}^0 - \theta_3 W_{co}^0 \Delta_p - m_{nox}^d \quad (5)$$

where $m_{nox}^d$ is the $NO_x$ stored in the LNT at the end of the purge cycle that is detected by other means than the $NO_x$ model.

If the purge is terminated by a HEGO switch, then the stored $NO_x$ is purged out of the LNT, and $m_{nox}^d = 0$. A root seeking algorithm can be used to find $\theta_i$ to force e given by (5) to be zero. Or an iterative algorithm can be used (such as gradient descent or least squares algorithm) to adjust $\theta_i$ to reduce the error e.

If the purge it not terminated by a HEGO switch, but by the condition $m_{nox} < -m_o$ (i.e., by estimation, there is no $NO_x$ in the LNT and yet no HEGO switch has been detected), then the actual value of $m_{nox}^d$ cannot be detected. However, it is known that $m_{nox}^d > 0$ (because there is no HEGO switch) and, therefore, $e \leqq -m_o$. In this case, a sign based adaptation law (bang-bang adaptation) can be implemented to update the parameters $\theta_1$, $\theta_2$, $\theta_3$ to reduce the error.

In general, three parameters may not be sufficient to capture the uncertainties in the feedgas $NO_x$ and LNT model. Accordingly, the desired $\theta_1$, $\theta_2$, $\theta_3$ can be made functions of operating conditions such as engine speed and load. In particular, since the variable $\theta_1$ includes the variation in feedgas $NO_x$ which is a strong function of operating conditions, the following representation is used so that the model can be updated in different operating regimes according to different weighting functions:

$$\theta_1 = \sum_{i=1}^{N} \theta_{1i} s_i(N^i, T_q^i)$$

where the speed/load space $(N, T_q)$ is divided into N separate cells and each cell is characterized by $(N^i, T_q^i)$. $\theta_{1i}$, i=1: N are parameters which can be adjusted on-line (default $\theta_{1i}=1$). $s_i$ is the fraction of time spent in cell i for the time period considered. For each adaptation interval (which corresponds to the normal lean operation interval $\Delta_n$), $s_i$ is reset to 0 at the beginning of the interval and updated to keep track of the time spent in cell i. At the end of the interval, the values of $s_i$ will be used as a weighting function in adaptation.

Figure 2:
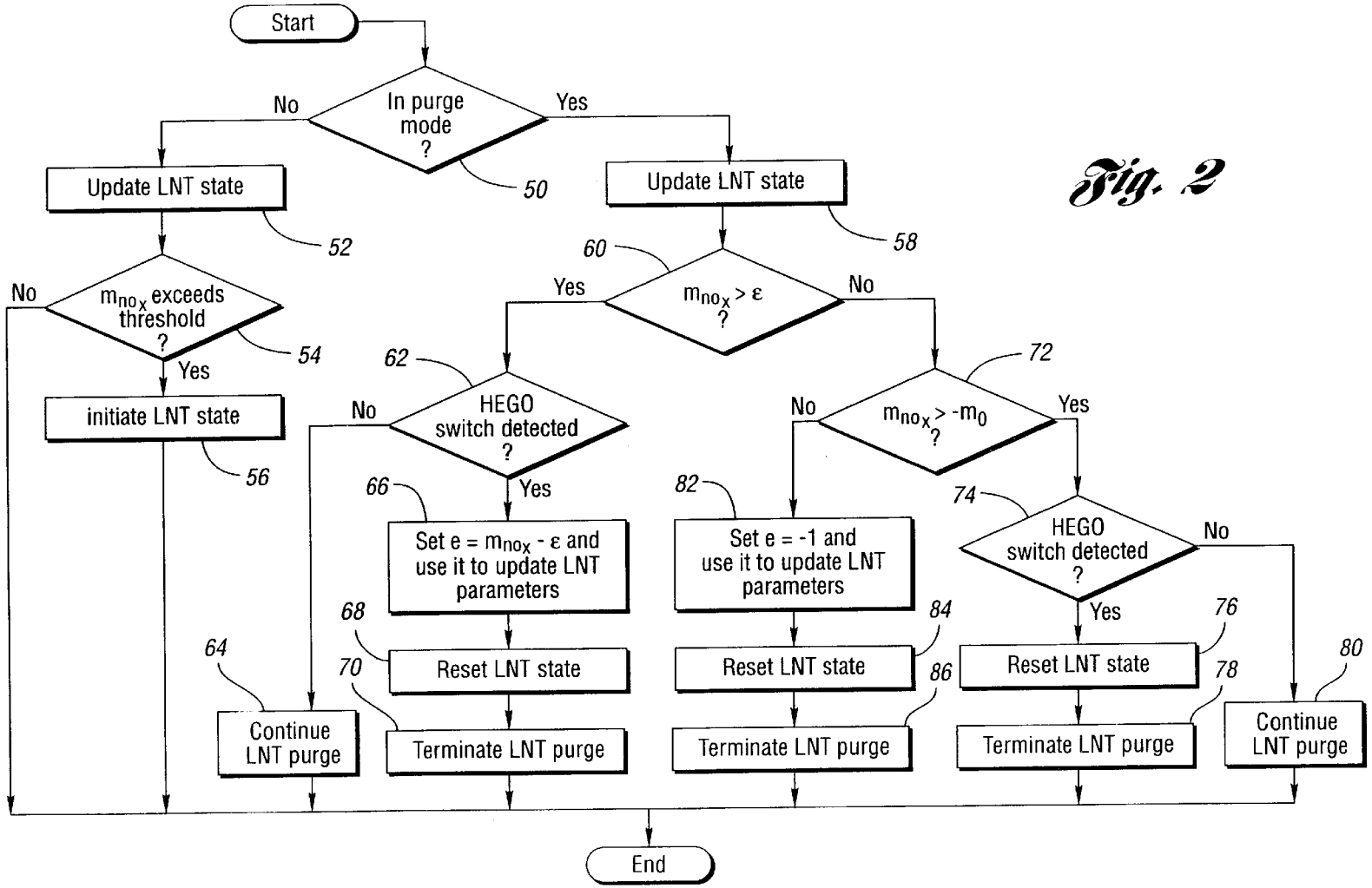
FIG. 2 is a flowchart depicting the method of managing LNT purge and adaptation.

Referring now to the flowchart of FIG. 2, the method of the present invention is shown. Prior to entering the routine depicted, an initialization is performed that purges the LNT until a HEGO switch is detected. When the routine of FIG. 2 is entered, a decision is made at block 50 as to whether the LNT is being purged. If not in the purge mode, the estimation of $m_{nox}$ is updated according to Equations (1) and (2) as indicated in block 52. At block 54, if $m_{nox} > P_u$ (the threshold for activating the LNT purge), a purge is initiated as indicated in block 56. Otherwise the routine is ended.

If a purge is initiated, the next time through the loop the estimate of $m_{nox}$ is updated, as indicated in block 58, according to equations (1) and (3). At block 60 a determination is made whether $m_{nox}>\epsilon$. $\epsilon$ is a calibration constant or threshold that is determined during the calibration process. When $m_{nox}$ is below this threshold, the LNT is considered essentially empty. The purge is continued, as indicated in blocks 62 and 64 if a HEGO switch is not detected. If $m_{nox}>\epsilon$, and a HEGO switch is detected, an estimation error $e=m_{nox}(t_d)-\epsilon$ where $t_d$ is the time when the HEGO switch is detected, is determined and used to update LNT parameters as indicated in block 66. The internal state of the LNT is reset by making $m_{nox}=0$ at block 68 and the purge is terminated as indicated in block 70. In other words, if a HEGO switch is detected before the estimated $NO_x$ storage has dropped below the calibration constant $\epsilon$, then the purge is terminated and the estimation error e, used to update the LNT parameters, is the value of $m_{nox}$ reduced by the calibration constant.

On the other hand, if a HEGO switch is detected while $-m_o \leqq m_{nox} \leqq \epsilon$, as determined by the blocks 60, 72, 74, then e is reset to e=0 and the state of the LNT is reset to $m_{nox}=0$ and the purge is terminated as indicated in blocks 76 and 78. If a HEGO switch is not detected then the purge is continued as indicated in block 80. In other words, if a HEGO switch is detected before the estimated $NO_x$ storage has dropped below the termination threshold then the purge is terminated and the estimation error e, used to update the LNT parameters, is set to 0. In this case the model prediction is considered to be reasonably accurate and no adaptation is necessary.

If it is determined at block 72 that $m_{nox} \leqq -m_o$ and no HEGO switch has been detected yet, then the estimation error is set to −1 and used to update the LNT parameters, the LNT internal state is reset and the purge is terminated as indicated in blocks 82, 84, and 86. In other words if the estimated $NO_x$ drops below the termination threshold before a HEGO switch occurs, then the purge is terminated and the estimation error e, used to update the LNT parameters, is set to −1.

Thus, once the purge mode is entered $m_{nox}$, the estimated value of $NO_x$ remaining in the trap, is compared to a $NO_x$ window having an upper threshold equal to the calibration constant c and a lower threshold equal to a calibration purge termination value $-m_o$. The estimation error is set to 0 if the HEGO sensor switches states from lean to rich while $m_{nox}$ is within the window. The estimation error is the difference between $m_{nox}$ and the upper threshold if the sensor switches states while $m_{nox}$ is above the upper threshold, and the estimation error is set to −1 if the sensor does not switch states before $m_{nox}$ drops below the lower threshold.

The updating of the parameters $\theta_{1i},\theta_2,\theta_3$, using the estimation error may be expressed by the following equations:

$$\theta_{1i}^{new} = \theta_{1i}^{old} - \frac{s_i}{\sum_1^N s_i}\gamma_1 e$$

where $\gamma_1,\gamma_2,\gamma_3$ are adaptation step sizes (or learning rates).

While the best mode for carrying out the present invention has been described in detail, those familiar with the art to which this invention relates will recognize various alternative designs and embodiments for practicing the invention as defined by the following claims.

What is claimed is:

1. A method of terminating the purge of a trap located in the exhaust path of an engine with an exhaust gas oxygen sensor located downstream of the trap, comprising a sequence of the following steps:

periodically updating an estimation of the amount of $NO_x$ accumulated in the trap based on a $NO_x$ model;

said $NO_x$ model comprising a plurality of adaptable parameters;

initiating a purge of the trap to remove $NO_x$ when the amount of estimated $NO_x$ accumulated in the trap exceeds a predetermined amount;

during purging of the trap periodically updating the estimation of the amount of $NO_x$ remaining in the trap based on the $NO_x$ model;

terminating the purge and determining an estimation error based on the relationship between the estimated amount of $NO_x$ remaining in the trap and a $NO_x$ window having predetermined upper and lower threshold values;

using the estimation error to update said adaptable parameters of the $NO_x$ model; and resetting the estimated amount of $NO_x$ in the trap to zero wherein the $NO_x$ model is represented by the following equations:

$$W_{nox}=(a(N,P,r_c,F_c)+b(N,P,r_c,F_c)(\delta-\delta_{MBT}))W_f \quad (1)$$

$$\dot{m}_{nox} = f_c W_{nox}\left(1 - \frac{m_{nox}}{c_{lnt}}\right) \text{ in normal operation} \quad (2)$$

$$\dot{m}_{nox}=-W_{co}(N,P) \text{ in purge operation} \quad (3)$$

where $W_f$ fueling rate $W_{nox}$ estimate of feedgas $NO_x$ flow rate $W_{co}$ estimate of feedgas CO flow rate $m_{nox}$ total $NO_x$ stored in LNT N engine speed P intake manifold pressure $r_c$ in-cylinder air/fuel ratio $F_c$ in-cylinder burned gas fraction $\delta$ spark timing $\delta_{MBT}$ spark timing corresponds to maximum brake torque $c_{lnt}$ the LNT storage capacity, dependent on trap temperature $f_c$ a compounded factor of TWC conversion and LNT absorbing efficiencies and wherein the amount of $NO_x$ stored in the trap at the end of a $NO_x$ purge cycle of time interval $\Delta_p$ following a $NO_x$ accumulation cycle of time interval $\Delta_n$ is given by:

$$m_{nox}^e = \theta_2\left(1 - e^{-\frac{\theta_1 f_c^0 W_{nox}^0 \Delta_n}{c_{lnt}^0}}\right)c_{lnt}^0 - \theta_3 W_{co}^0 \Delta_p$$

and wherein the estimation error used to adapt $\theta_1$, $\theta_2$, $\theta_3$, is defined as:

$$e = m_{nox}^e - m_{nox}^d = \theta_2\left(1 - e^{-\frac{\theta_1 f_c^0 W_{nox}^0 \Delta_n}{c_{lnt}^0}}\right)c_{lnt}^0 - \theta_3 W_{co}^0 \Delta_p - m_{nox}^d$$

where $m_{nox}$ is the $NO_x$ stored in the LNT when the sensor switches state, and where $W_{NOx}{}^0$, $W_{CO}{}^0$, $f_c{}^0$, $c_{lnt}{}^0$ are nominal models for feedgas $NO_x$ flow rate, feedgas CO flow rate, compounded factor of TWC conversion and LNT absorbing efficiencies and the LNT storage capacity.

2. The method of claim 1 wherein the estimation error is a negative number if the estimated $NO_x$ remaining in the trap drops below the lower threshold before said sensor switches state.

3. The method of claim 1 wherein the estimation error is 0 to prevent any change in the adaptable parameters if the estimated $NO_x$ remaining in the trap is between the upper and lower thresholds when the sensor switches state.

4. The method of claim 1 wherein the estimation error is the difference between the estimated $NO_x$ remaining in the trap and the upper threshold if the estimated $NO_x$ remaining in the trap is above the upper threshold when the sensor switches state.

5. The method defined in claim 1 wherein the estimation error is 0 if the sensor switches states while the estimated amount of $NO_x$ remaining in the trap is between the upper and lower threshold value, the estimation error is equal to the difference between the estimated $NO_x$ remaining in the trap and the upper threshold if the sensor switches states and the estimated $NO_x$ remaining in the trap is above the upper threshold, and the estimation error is −1 if the sensor does not switch states before the estimated $NO_x$ remaining in the trap drops below the lower threshold.

6. A system for terminating the purge of a trap located in the exhaust path of an engine with an exhaust gas oxygen sensor located downstream of the trap, comprising:

means for periodically updating an estimation of the amount of $NO_x$ accumulated in the trap based on a $NO_x$ model, said $NO_x$ model comprising a plurality of adaptable parameters;

means for initiating a purge of the trap to remove $NO_x$ when the amount of estimated $NO_x$ accumulated in the trap exceeds a predetermined amount;

means for periodically updating the estimation of the amount of $NO_x$ remaining in the trap during purging of the trap based on the $NO_x$ model;

means for terminating the purge and determining an estimation error based on the relationship between the estimated amount of $NO_x$ remaining in the trap and a $NO_x$ window having predetermined upper and lower threshold values;

means for updating said adaptable parameters of the $NO_x$ model using the estimation error; and means for resetting the estimated amount of $NO_x$ in the trap to zero wherein the $NO_x$ model is represented by the following equations:

$$W_{nox}=(a(N,P,r_c,F_c)+b(N,P,r_c,F_c)(\delta-\delta_{MBT}))W_f \quad (1)$$

$$\dot{m}_{nox} = f_c W_{nox}\left(1 - \frac{m_{nox}}{c_{lnt}}\right) \text{ in normal operation} \quad (2)$$

in normal operation $$\dot{m}_{nox}=-W_{co}(N,P) \text{ in purge operation} \quad (3)$$

where $W_f$ fueling rate $W_{nox}$ estimate of feedgas $NO_x$ flow rate $W_{co}$ estimate of feedgas CO flow rate $m_{nox}$ total $NO_x$ stored in LNT N engine speed P intake manifold pressure $r_c$ in-cylinder air/fuel ratio $F_c$ in-cylinder burned gas fraction δ spark timing $\delta_{MBT}$ spark timing corresponds to maximum brake torque $c_{lnt}$ the LNT storage capacity, dependent on trap temperature $f_c$ a compounded factor of TWC conversion and LNT absorbing efficiencies and;

wherein the amount of $NO_x$ stored in the trap at the end of a $NO_x$ purge cycle of time interval $\Delta_p$ following a $NO_x$ accumulation cycle of time interval $\Delta_n$ is given by:

$$m_{nox}^{e} = \theta_2\left(1 - e^{-\frac{\theta_1 f_c^0 W_{nox}^0 \Delta_n}{c_{lnt}^0}}\right)c_{lnt}^0 - \theta_3 W_{co}^0 \Delta_p$$

and wherein the estimation error used to adapt $\theta_1$, $\theta_2$, $\theta_3$, is defined as:

$$e = m_{nox}^{e} - m_{nox}^{d} = \theta_2\left(1 - e^{-\frac{\theta_1 f_c^0 W_{nox}^0 \Delta_n}{c_{lnt}^0}}\right)c_{lnt}^0 - \theta_3 W_{co}^0 \Delta_p - m_{nox}^{d}$$

where $m_{nox}^{d}$ is the $NO_x$ stored in the LNT when the sensor switches state, and where $W_{NOx}^0$, $W_{CO}^0$, $f_c^0$, $c_{lnt}^0$ are nominal models for feedgas $NO_x$ flow rate, feedgas CO flow rate, compounded factor of TWC conversion and LNT absorbing efficiencies and the LNT storage capacity.

7. The system of claim 6 wherein the purge is terminated if the estimated $NO_x$ remaining in the trap is below the lower threshold and wherein the estimation error is set to a negative number.

8. The system of claim 7 wherein the purge is terminated if the estimated $NO_x$ remaining in the trap is below the lower threshold and wherein the estimation error is set to −1.

9. The system of claim 7 wherein the purge is terminated if the sensor switches states and the estimated $NO_x$ remaining in the trap is between the upper and lower thresholds and wherein the estimation error is set to 0.

10. The invention defined in claim 6 wherein the estimation error is 0 if the sensor switches states while the estimated amount of $NO_x$ remaining in the trap is between the upper and lower threshold value, the estimation error is equal to the difference between the estimated $NO_x$ remaining in the trap and the upper threshold if the sensor switches states and the estimated $NO_x$ remaining in the trap is above the upper threshold, and the estimation error is −1 if the sensor does not switch states before the estimated $NO_x$ remaining in the trap drops below the lower threshold.

11. An article of manufacture comprising:

a storage medium having a computer program encoded therein for causing a microcontroller to control termination of the purge of a trap located in the exhaust path of an engine with an exhaust gas oxygen sensor located downstream of the trap, said program including:

code for periodically updating an estimation of the amount of $NO_x$ accumulated in the trap based on a $NO_x$ model, said $NO_x$ model comprising a plurality of adaptable parameters;

code for initiating a purge of the trap to remove $NO_x$ when the amount of estimated $NO_x$ accumulated in the trap exceeds a predetermined amount;

code for periodically updating the estimation of the amount of $NO_x$ remaining in the trap during purging of the trap based on the $NO_x$ model;

code for terminating the purge and determining an estimation error based on the relationship between the estimated amount of $NO_x$ remaining in the trap and a $NO_x$ window having predetermined upper and lower threshold values;

code for updating said adaptable parameters of the $NO_x$ model using the estimation error; and code for resetting the estimated amount of $NO_x$ in the trap to zero wherein the estimation error is 0 if the sensor switches states while the estimated amount of $NO_x$ remaining in the trap is between the upper and lower threshold value, the estimation error is equal to the difference between the estimated $NO_x$ remaining in the trap and the upper threshold if the sensor switches states and the estimated $NO_x$ remaining in the trap is above the upper threshold, and the estimation error is −1 if the sensor does not switch states before the estimated $NO_x$ remaining in the trap drops below the lower threshold and:

wherein the amount of $NO_x$ stored in the trap at the end of a $NO_x$ purge cycle of time interval Δp following a $NO_x$ accumulation cycle of time interval Δn is given by:

$$m_{nox}^{e} = \theta_2\left(1 - e^{-\frac{\theta_1 f_c^0 W_{nox}^0 \Delta_n}{c_{lnt}^0}}\right) c_{lnt}^0 - \theta_3 W_{co}^0 \Delta_p$$

and wherein the estimation error used to adapt θ1, θ2, θ3, is defined as:

$$e = m_{nox}^{e} - m_{nox}^{d} = \theta_2\left(1 - e^{-\frac{\theta_1 f_c^0 W_{nox}^0 \Delta_n}{c_{lnt}^0}}\right) c_{lnt}^0 - \theta_3 W_{co}^0 \Delta_p - m_{nox}^{d}$$

where $m_{nox}^{d}$ is the $NO_x$ stored in the LNT when the sensor switches state, and where $W_{NOx}^{0}$, $W_{CO}^{0}$, $f_c^{0}$, $c_{lnt}^{0}$ are nominal models for feedgas $NO_x$ flow rate, feedgas CO flow rate, compounded factor of TWC conversion and LNT absorbing efficiencies and the LNT storage capacity.

12. The article of claim 11 wherein the purge is terminated if the estimated $NO_x$ remaining in the trap is below the lower threshold and wherein the estimation error is set to a negative number.

13. The article of claim 11 wherein the purge is terminated if the sensor switches states and the estimated $NO_x$ remaining in the trap is between the upper and lower thresholds and wherein the estimation error is set to 0.

14. The article of claim 11 wherein the estimation error is the difference between the estimated $NO_x$ remaining in the trap and the upper threshold if the sensor switches states and the estimated $NO_x$ remaining in the trap is above the upper threshold.

15. The article defined in claim 11 wherein the parameters $\theta_1$, $\theta_2$, $\theta_3$, are adapted according to the equations:

$$\theta_{1i}^{new} = \theta_{1i}^{old} - \frac{s_i}{\sum_{1}^{N} s_i}\gamma_1 e$$

$$\theta_2^{new} = \theta_2^{old} - \gamma_2 e$$

$$\theta_3^{new} = \theta_3^{old} + \gamma_3 e$$

where $\gamma_1$, $\gamma_2$, $\gamma_3$ are adaptation step sizes and $s_i$ is the fraction of time spent in speed (N), torque ($T_q$) cell i for the time period considered.

* * * * *